US006176713B1

(12) United States Patent
Okabe

(10) Patent No.: US 6,176,713 B1
(45) Date of Patent: Jan. 23, 2001

(54) ELECTRICAL CONNECTOR

(75) Inventor: Toshiaki Okabe, Shizuoka (JP)

(73) Assignee: Yazaki Corporation, Tokyo (JP)

( * ) Notice: Under 35 U.S.C. 154(b), the term of this patent shall be extended for 0 days.

(21) Appl. No.: 09/280,677

(22) Filed: Mar. 29, 1999

(30) Foreign Application Priority Data

Mar. 30, 1998 (JP) ..... 10-083038

(51) Int. Cl.[7] ..... H01R 13/62
(52) U.S. Cl. ..... 439/157
(58) Field of Search ..... 439/157, 372, 439/160

(56) References Cited

U.S. PATENT DOCUMENTS 5,445,530 * 8/1995 Inoue ..... 439/157
5,681,175 * 10/1997 Busse et al. ..... 439/157

* cited by examiner

*Primary Examiner*—Brian Sircus
*Assistant Examiner*—Chandrika Prasad
(74) *Attorney, Agent, or Firm*—Sughrue, Mion, Zinn, Macpeak & Seas, PLLC

(57) ABSTRACT

An electrical connector in which the fitting force for connecting male and female connectors to each other is enhanced by using a lever force exerted by a lever, and, when transported under a provisionally assembled state, a lever or a harness wire of another connector is prevented from being snagged, thereby, improving the efficiency of the assembly work, and preventing the members from being damaged. A lever (30) is pivotally supported on a female connector (20) cooperating with a male connector (10) to form a fitting pair, through pins (12*c*) serving as lever support shafts. The front end portion of the lever (30) is formed as a force application point portion (32) for applying a pressing operation force for pressingly fitting the male connector (10) into the female connector (20). Action point portions (39) in the rear end portion lock the male connector (10) to the female connector (20). A slit (38) and a rib (11*b*), which cooperate with each other for closing are disposed in the front end face (33) of the force application point portion (32) of the lever (30), and the front end face (11*a*) of the male connector (10*a*), respectively. The rib blocks an electrical wire (3) of a wire harness terminal of another connector provisional assembly, or the like from being snagged into a gap C (see FIG. 12) which is formed between the force application point portion (32) and the front end portion of the male connector (10). The slit (38) and the rib (11*b*) of the protection means are always engaged at least partly with each other to close the gap C, irrespective of whether the lever (30) has been pressed or not.

11 Claims, 11 Drawing Sheets

ELECTRICAL CONNECTOR

BACKGROUND OF THE INVENTION

1. Field of the Invention

The present invention relates to an electrical connector having a male and female fitting pair, and more particularly to an electrical connector in which the fitting force for connecting male and female connectors to each other is enhanced by a cam force exerted by an appended lever.

2. Discussion of Related Art

FIG. 11 shows an example of an electrical connector of this kind, in a state where male and female connectors 1 and 2 have not yet been coupled to each other. The one or male connector 1 is in a state where electrical wires 3 are respectively connected to plural terminals, so as to be prepared for fitting with the other or female connector 2. The female connector 2 includes a housing section 2*a* which is formed integrally with an upper cover 4*a* of an electrical connection box 4. Referring also to FIG. 2, the connection box 4 includes male terminal portions 4*e* which are terminal portions of bus bars 4*d* projecting into the housing section 2*a*. When the corresponding terminals are to be connected to each other, the male connector 1 is pressed into the female connector 2 so as to be fitted thereinto.

Recently, in an electronic apparatus or an electrical facility, the number of terminals of an electrical connector tends to be relatively large as circuit wiring is formed in a higher density and in a more complex manner. Consequently, in order to surely connect terminals of male and female connectors to each other with a single operation, a large fitting force is required.

To comply with this requirement, an electrical connector having a structure which is provided with a cam lever 5 as shown in FIG. 11 is known. In this case, the lever 5 is coupled with the male connector 1 in a previous production step so as to be assembled therewith, so that it is prepared to be fitted with the female connector 2 in the next production step.

In the lever 5, rotation holes 5*i* are formed at appropriate positions in the longitudinal direction of the lever body 5*a* constituting a frame of the lever 5. Support shaft pins 5*b* extending from side walls of the male connector 1 are respectively inserted into the rotation holes 5*i*, so that the lever 5 is rotatable about the support shaft pins 5*b*. The front end portion of the lever body 5*a* serves as a force application point portion 5*c*. When the worker applies a pressing force indicated by the arrow P in FIG. 11 to the force application point portion, the lever body 5*a* rotates about the support shaft pins 5*b* in a clockwise direction in the figure. Thus, the lever body 5*a* functions to connect the male and female connectors to each other by a cam action. The fitting and locking functions of the lever 5 are configured in the following manner.

As a fitting mechanism, a lock piece 5*e* in the form of a cantilever is disposed below the force application point portion 5*c* of the lever body 5*a* so as to be located between a pair of right and left slits 5*d*. An engaging portion 5*g* projects from the lock piece 5*e*. The engaging portion 5*g* is received in an engaging recess (not shown) formed in the inner face of a front side wall 2*a* of the female connector 2, and the lever body 5*a* is then undercut-fitted with a single operation and a clicking sensation is experienced due to the elastic deformation of the lock piece 5*e*.

As a locking mechanism, action point portions 5*h* project from the rear end portion of the lever body 5*a* in contrast to the force application point portion 5*c* in the front end portion. The action point portions 5*h* are movably and engagingly inserted by a lever rotation operation, into vertical slits 1*a* in the form of long grooves which are formed in the rear end portion of the male connector 1, respectively. Vertical slits 2*b* are formed, in a side wall of the rear portion of the female connector 2 at locations respectively corresponding to the vertical slits 1*a*.

When pressing the male connector 1 into the female connector 2, the body 5*a* of the lever 5 is operated to rotate in a clockwise direction in the figure. Therefore, the action point portions 5*h* in the rear end portion of the lever body 5*a* are engagingly inserted into the slits 2*b* of the female connector 2. Since the action point portions 5*h* are engaged in both the slits 1*a* and 2*b*, the action point portions 5*h* push against the rear end portion of the female connector 2, so as to pressingly lock the male connector 1.

FIG. 2 shows an example of the internal structure of the electrical connection box 4. In this example, the housing section 2*a* of the female connector 2 is formed integrally with the upper cover 4*a* of the electrical connection box 4. When the male connector 1 is pressingly fitted into the female connector 2 by operating the lever 5, fitting connection between the connector terminals causes the terminals of the electrical wires 3 to be electrically connected to the bus bars 4*d* on a circuit board 4*c* laminated between the upper cover 4*a* and a lower cover 4*b*.

In contrast, when the electrical connector must be detached from the connection box and the male connector 1 is to be detached from the female connector 2 on the side of the electrical connection box 4, the lever 5 is operated so as to rotate in a counterclockwise direction about the support shaft pins 5*b* serving as the lever fulcrum. As a result, the locking state due to the lever 5 is cancelled, so that the male connector 1 can be easily detached from the female connector 2.

The electrical connector provided with the lever shown in FIG. 11 has the following problem which remains to be solved. In order to connect the male connector 1 to the female connector 2 on the side of the electrical connection box 4, the male connector 1 and the lever 5 are preassembled in a previous production step as a provisional connector assembly in a semimanufactured state. A large number of such provisional connector assemblies in the form of semimanufactured articles are transported over a long distance, or conveyed in a production line to the next production step of assembling each provisional assembly with the female connector 2.

During such transportation, as shown in FIG. 12, one or more of the electrical wires 3 of one provisional connector assembly may be snagged in a gap C which is formed between the front end portion of the male connector 1 and the free end or force application point portion 5*c* of the lever 5 associated with another connector assembly. Further, occasionally, the lever 5 of another provisional connector assembly may become snagged in the gap C. When the electrical wire 3 or the lever 5 become snagged, there arises the possibility that the lock piece 5*e* may be damaged.

It is an object of the invention to provide an electrical connector in which the fitting force for connecting male and female connectors to each other is enhanced by using a cam force exerted by a lever, and, when transported under a provisionally assembled state, a lever or an electrical wire of another connector is prevented from being snagged, thereby preventing the connectors from-being damaged by interference between members.

SUMMARY OF THE INVENTION

In the electrical connector of the invention, a terminal portion of an electrical wire is connected to a terminal of a one or male connector, a lever for magnifying a pressing force in fitting of the terminal to a terminal of another or female connector to electrically connect the terminals to each other is pivotally supported on the male connector through a lever support shaft, a force application point portion for applying a pressing operation force and configured by a free end is disposed at a one end portion of the lever in a longitudinal direction with respect to a fulcrum configured by the lever support shaft, and an action point portion for locking the male connector at a fitting position to the female connector is disposed at another end portion of the lever. In this configuration, protection means for closing a gap which is formed between the free end or force application point portion of the lever and the one end portion of the male connector by means of cooperation of end portions of the lever and the male connector is disposed to prevent an electrical wire terminal portion of another member, or the other member itself from being snagged in the gap.

The protection means may be configured so that one recess and another projection which are respectively formed on the force application point portion and a one end portion of the male connector are engaged at least partly and flushly with each other to enable the gap to be always closed. Specifically, the recess may be a groove-like slit which is formed in an end face of the force application point portion and in a rotation direction of the lever, and the projection which is to be engaged partly and flushly with the slit may be a rib which is stepwise formed so as to be elongated along an end face of the one end portion of the male connector, the rib having a convex section shape.

The recess and projection engagement relationships may be inverted, or the recess may be a groove-like slit which is formed in an end face of the one end portion of the male connector and in a rotation direction of the lever. In this case, the projection which is to be engaged partly and flushly with the slit may be a stem-like rib which extends from an end face of the force application point portion.

An elastic fitting portion may be formed which is sandwiched between two cutaway grooves disposed in lateral sides of the end face of the force application point portion, respectively, and which has an elastically deformable cantilever shape. In this case, the slit or the stem-like rib may be disposed in the elastic fitting portion. The engagement can be further made detectable by using the elastic deformation of the elastic fitting portion.

It is possible to configure a structure in which, by using the elastic fitting portion, a wide skirt portion is formed on the elastic fitting portion to be elongated from a free end of the elastic fitting portion, and the skirt portion is disposed as the protection means so as to be slidingly contactable with the end face of the one end portion of the male connector.

In the configurations described above, the gap which is formed between the free end or force application point portion of the lever and the one end portion of the male connector is closed by the protection means which is due to, for example, recess and projection engagement relationships between the slit and the rib. Therefore, the protection means can block, for example, an electrical wire or the like of one provisional connector assembly transported in the form of a semimanufactured article in which the lever is coupled with the male connector, from being snagged in a gap of another provisional connector assembly which is transported together with the one provisional connector assembly.

BRIEF DESCRIPTION OF THE DRAWINGS

FIG. 6(*c*) is an assembly side section view;

DETAILED DESCRIPTION OF THE INVENTION

Figure 11:
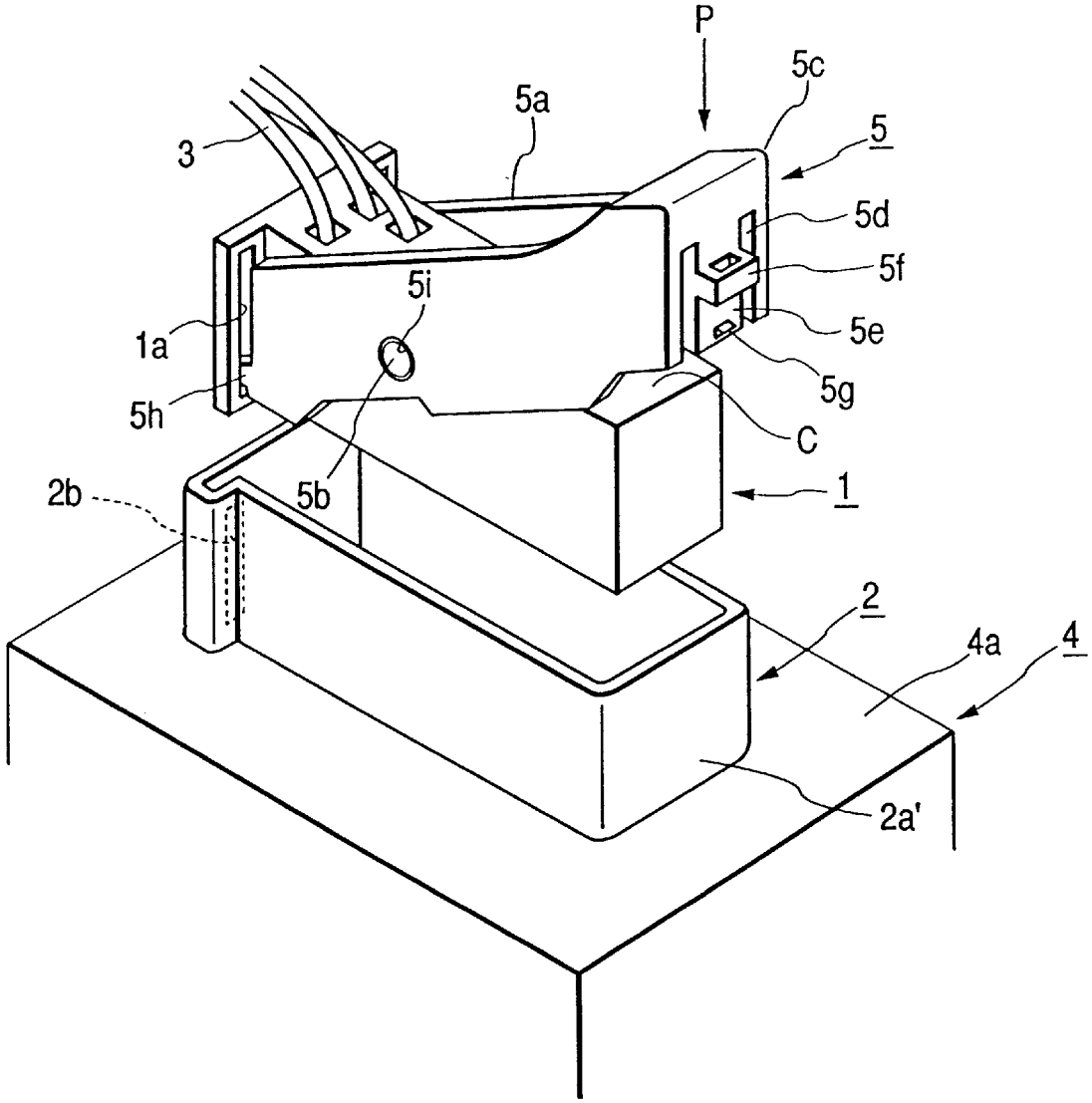
FIG. 11 PRIOR ART
FIG. 11 is an exploded perspective view showing a state immediately before connection by fitting of an electrical connector of a prior art example.

Hereinafter, embodiments of the electrical connector of the invention will be described in detail with reference to the accompanying drawings. Components which are identical with those of the electrical connector of FIG. 11 which has been described as a conventional example are denoted by the same reference numerals, and description of such components is omitted or the components will be briefly described.

Figure 1:
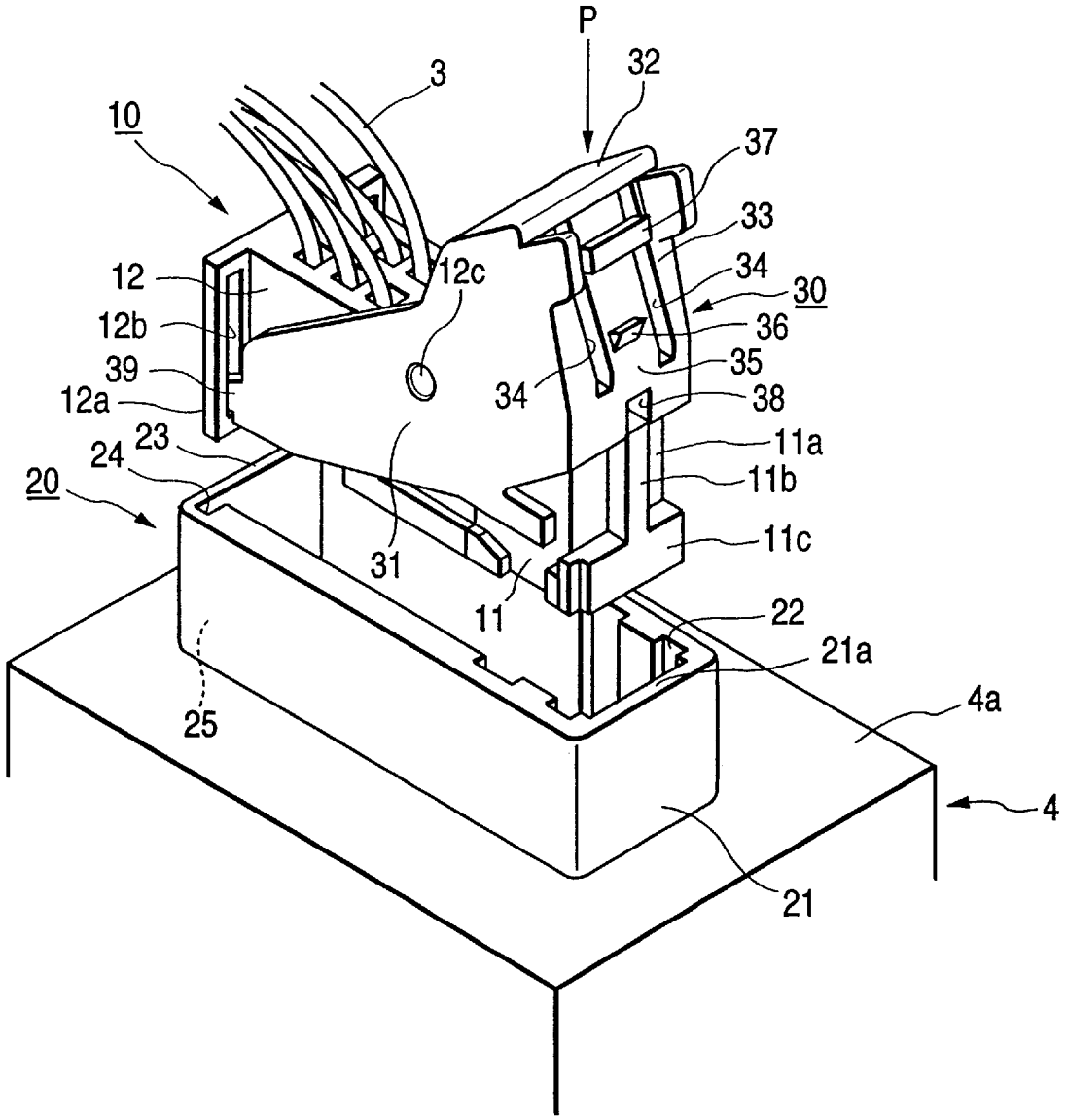
FIG. 1 is an perspective view showing a state immediately before connection by fitting of an electrical connector in a first embodiment of the invention.
Figure 2:
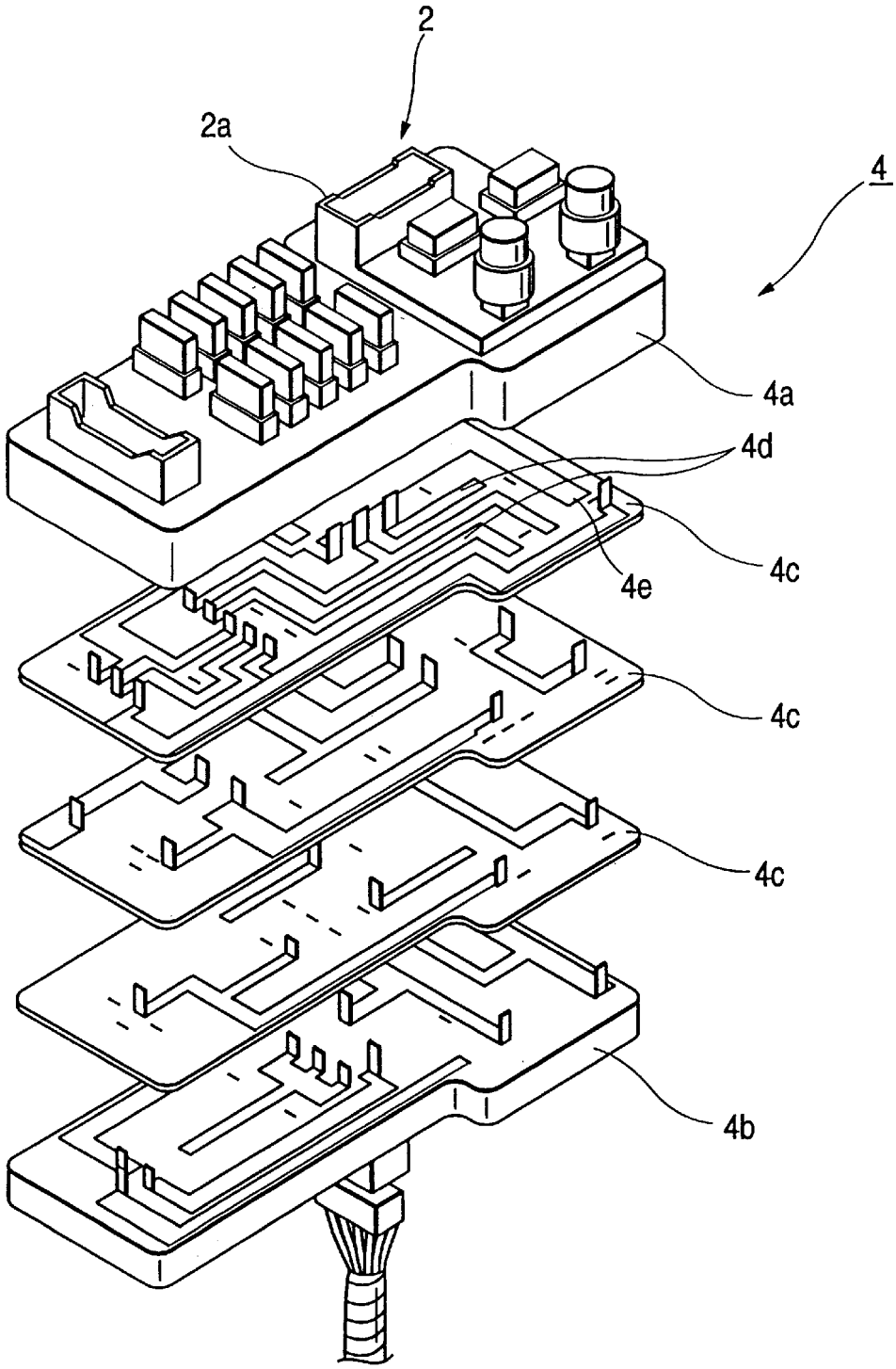
FIG. 2 is an exploded perspective view showing an example of the internal structure of an example of an electrical connection box in which a female connector is integrally formed.
Figure 4A:
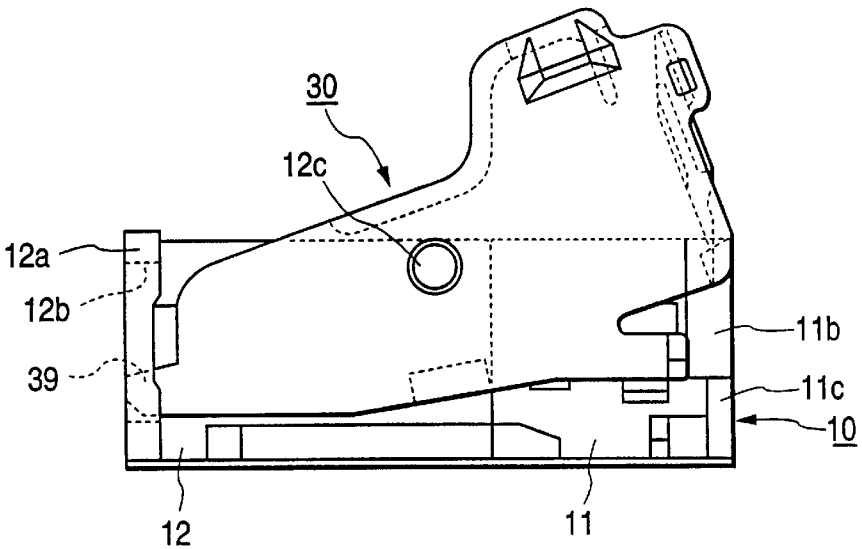
FIG. 4(*a*) is a side view showing a connector assembly of the male connector and the lever in the first embodiment, FIG. 4(*b*) is a plan view showing only the male connector, and FIG. 4(*c*) is a plan view showing only the lever.
Figure 4B:
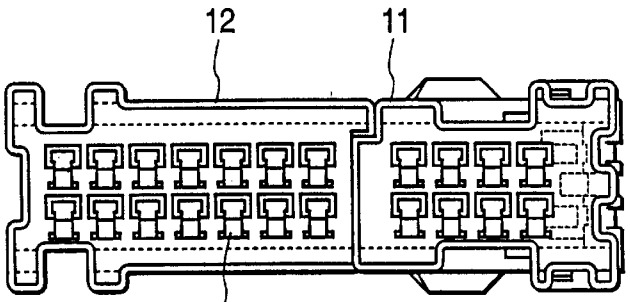
Figure 4C:
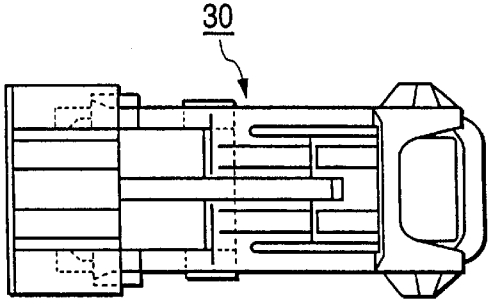

FIG. 1 is a perspective view showing an electrical connector of a first embodiment. The electrical connector has one male connector 10 and another female connector 20 which constitute a male and female fitting pair. The male connector 10 is in a state where electrical wires 3 are respectively connected to plural terminals 13 that are accommodated in the housing of the electrical connector, as shown in FIG. 4 and following figures. The male connector is formed as a provisional connector assembly in which a lever 30 for magnifying a fitting force in a connecting operation is coupled to the male connector. The female connector 20 is disposed as a female connector (portion) on the upper cover 4*a* of the electrical connection box 4 shown in FIG. 2, by integral molding or the like.

Figure 3A:
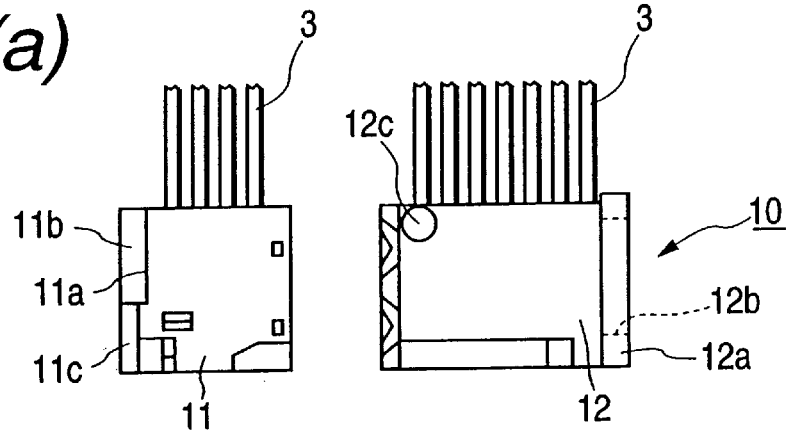
FIGS. 3(*a*)–(*c*) are side views sequentially illustrating the combined form of the male connector of the first embodiment and the state where a lever is attached to the combined male connector.
Figure 3B:
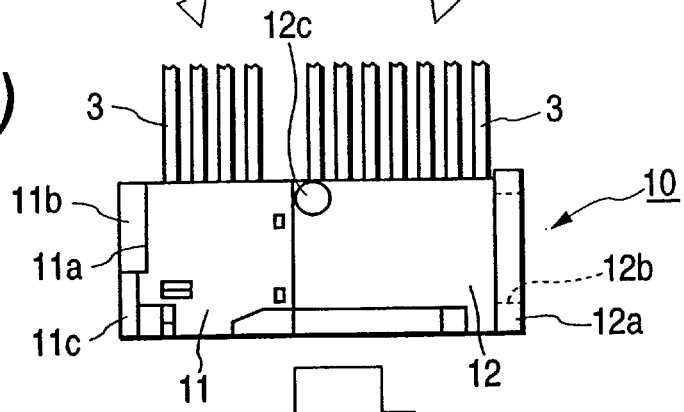
Figure 3C:
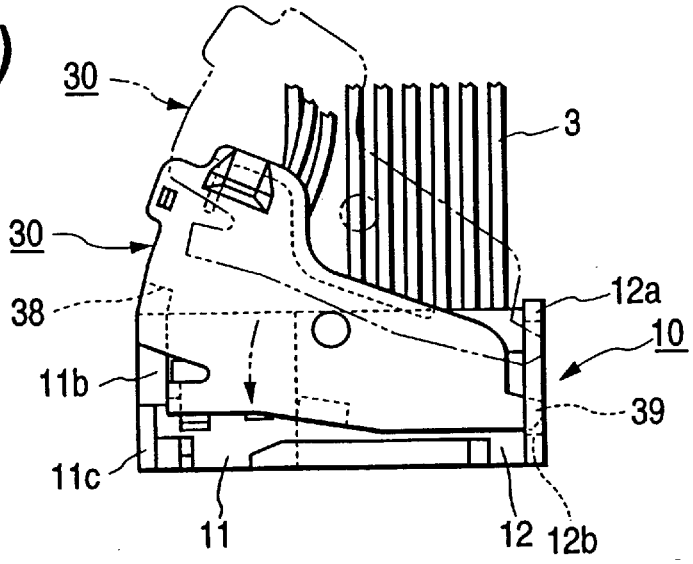

As shown in FIG. 3, the male connector 10 includes two male connector portions or a male connector left portion 11 and a male connector right portion 12 which can be coupled with or separated from each other with a single operation.

A rib 11*b* is formed on the front end face 11*a* of a housing side wall forming the male connector left portion 11. The rib 11*b* constitutes a protection means and includes vertical projection extending in the fitting direction of the female connector 20 or the vertical direction in the figure, i.e., in the rotation direction of the lever 30. As shown in FIG. 1, the rib 11*b* is set so as to be always engaged at least partly with a slit 38 formed in the lever 30 which is a counter portion cooperating as the protection means. An engaging step portion 11*c* is formed so as to laterally overhang from the lower end of the rib 11*b*. The engaging step portion 11*c* is slidingly engageable with and detachable from an engaging groove 22 formed inside the front end face 21 of a side wall forming a housing of the female connector 20.

Referring again to FIGS. 1 and 3, an engaging flange 12*a* is formed on each of the sides of the rear end face of a side housing wall forming the male connector right portion 12. Each of the engaging flanges has a vertical slit 12*b* in the form of a long groove which extends in the vertical direction. A pair of support shaft pins 12*c* project from the side faces of the housing side walls, respectively. The support shaft pins 12*c* are shafts serving as the lever fulcrum which rotatably supports the lever 30. FIGS. 4(*a*) to 4(*c*) are a side views showing a n assembled state where the lever 30 is pivotally supported on the male connector 10 in the combined state of FIG. 3, a plan view showing only the male connector 10, and a plan view showing only the lever 30, respectively.

Figure 5A:
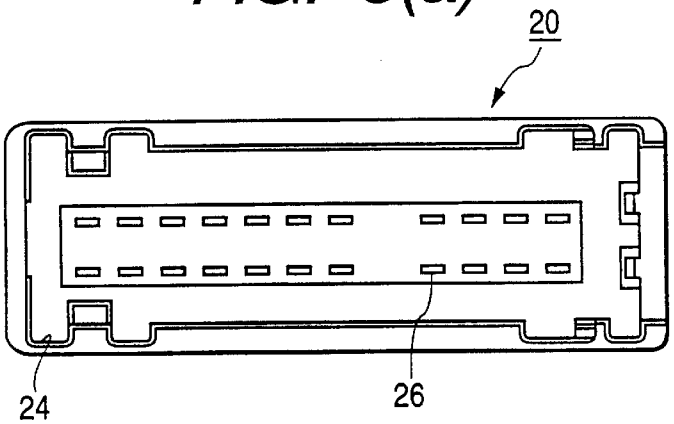
FIG. 5(*a*) is a plan view of a female connector member of the first embodiment, FIG. 5(*b*) is a side view of the female connector member, and FIG. 5(*c*) is a side section view of the female connector member.
Figure 5B:
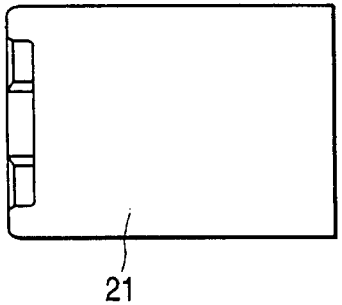
Figure 5C:
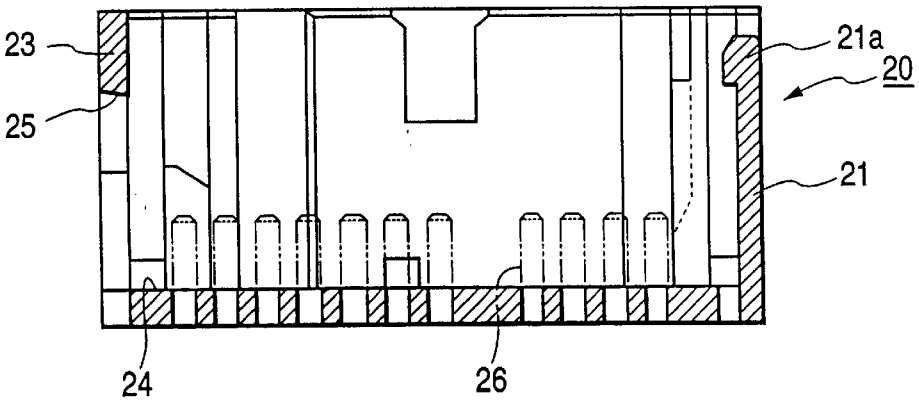

As shown in FIGS. 5(*a*) to 5(*c*), terminals 26, which correspond in number to that of the terminals 13 on the side of the male connector 10, extend upwardly so as to seen from the above. As shown in the one example of the internal structure of the electrical connection box 4 of FIG. 2, the fitting of the male connector 10 causes the terminals 13 and 26 to be connected to each other, so that the electrical wires 3 on the side of the male connector 10 are electrically connected to the bus bars 4*d* on the circuit board 4*c* laminated between the upper cover 4*a* and a lower cover 4*b*.

An engaging groove 24 is formed in each of the sides of the rear end portion 23 of the housing side walls of the female connector 20. The engaging flanges 12*a* disposed on the rear end portion of the male connector right portion 12 by the engaging grooves from the above in the figure, respectively. The locking function of the lever 30 in the invention is realized by the combined structure of the action point portions 39 of the rear end portion of the lever 30, the vertical slits 12*b* disposed on the sides of the rear end portion of the male connector right portion 12, the engaging grooves 24 disposed on the sides of the rear end portion 23 of the female connector 20, and vertical slits 25 which are respectively disposed in the vicinity of the engaging grooves 24 are combined with one another. Each of the vertical slits 25 is formed at a position coincident with the corresponding vertical slit 12*b* of the male connector right portion 12. The action point portions 39 of the rear end portion of the lever 30 are enabled to be engaged and disengaged through the vertical slits 12*b*. The locking and the unlocking operations due to the engagement and disengagement are identical with those which have been described above in the prior art example of FIG. 11.

The lever 30 is attached to the male connector 10 in which the male connector left portion 11 and the male connector right portion 12 are combined with each other in the assembling step of FIGS. 3(*a*)–(*c*), by pivotally supporting the lever through the support shaft pins 12*c*. The provisional connector assembly of the male connector 10 and the lever 30 is transported as a semimanufactured article for the next assembly step of fitting the assembly into the female connector 20.

As shown in the figures, the lever 30 is formed into a frame-like shape which straddles the housing of the male connector 10 from the both sides, and is rotatably supported on the male connector 10 through the support shaft pins 12*c*. For the sake of convenience in description, the right side in FIG. 1 is called a right front end portion 32 of the lever body 31 of the lever 30. The front end portion 32 functions as the force application point portion of the lever to which a fitting force P is applied from the above by a pressing operation by the worker. Two slits 34 are formed in right and left positions of the lower area of the front end face 33 of the force application point portion 32, respectively. The portion between the right and left slits 34 is formed as a lock piece 35 in the form of a cantilever in which the lower end is a free end.

An engaging projection 36 projects from a substantially center area of the lock piece 35. When the engaging projection 36 is moved along the inner face of the front end face 21 of the female connector 20, the engaging projection 36 is engaged with an engaging recess (not shown) formed in the inner face, by means of elastic flexibility of the elastic lock piece 35. This engagement is accompanied by a clicking sensation. As a result, the free end or force application point portion 32 can be fitted into the female connector 20 with a substantially single operation of the lever 30 itself.

In the lock piece 35, a vertical slit 38 constituting one member of the protection means of the invention is formed so as to extend toward the lower end which is a free end. The other member of the protection means is the above-mentioned vertical rib 11*b* which is stepwise formed along the front end face 11*a* of the male connector 10 in the lever rotating direction. As explained above, the slit receives the rib 11*b*.

The slit 38 on the side of the lever 30, and the rib 11*b* of the male connector 10, which constitute the protection means, are set so as to be partly engaged with each other at all times, i.e., in either extreme position of the lever 30 before and after the pressing that are obtained as a result of a lever rotation operation.

Figure 12:
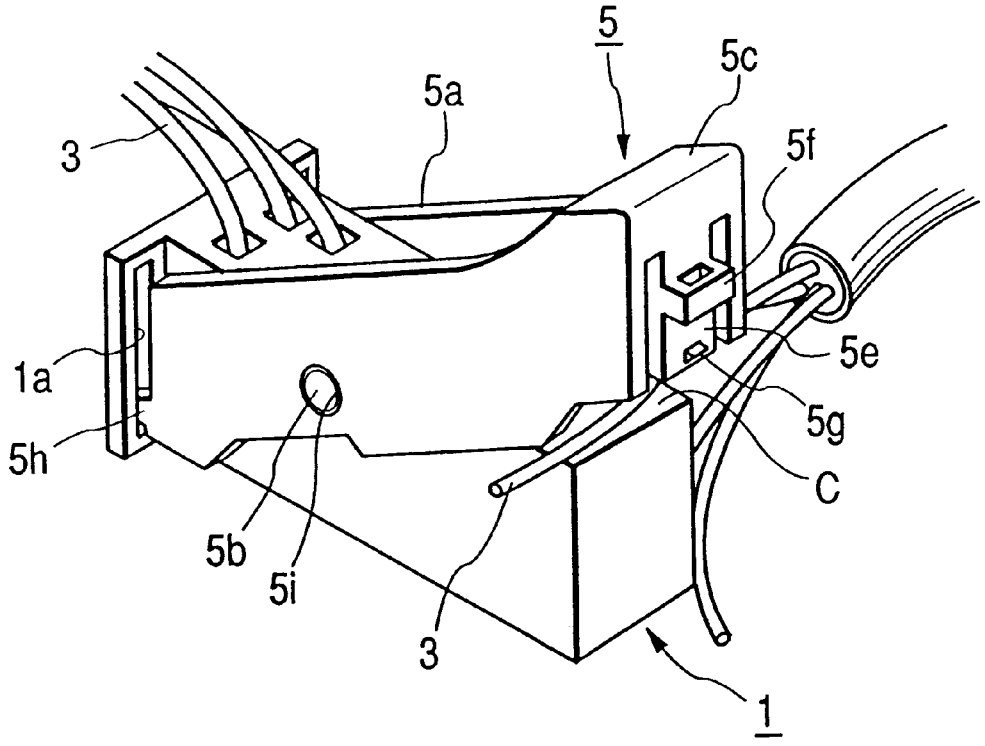
FIG. 12 PRIOR ART
FIG. 12 is a perspective view showing a state where a wire harness is snagged during transportation of connector assemblies of a male connector and a lever in the prior art example.

In this way, the slit 38 and the rib 11*b* are always at least partially engaged with each other. Therefore, during transportation of a large number of provisional connector assemblies, the snagging of the electrical wire 3 in a terminal portion of a wire harness of one provisional connector assembly into another provisional connector assembly as shown in the prior art example of FIG. 12 is prevented from occurring. Specifically, even when the gap C (see FIG. 12) is formed between the front end portions of the male connector 10 and the lever 30, it is possible to prevent the snagging of the electrical wire 3, by the protection means configured by the slit 35 and the rib 11*b* which are engaged with each other. As a result, in the process of fitting the provisional connector assembly into the female connector

20, the operation of the lever 30 is not hindered, the working efficiency is improved, and the disadvantage that the electrical wire 3 may be damaged is eliminated. Additionally, the lever of one provisional connector assembly and that of another provisional connector assembly will not to be tangled with each other so they will not be damaged.

Figure 6B:
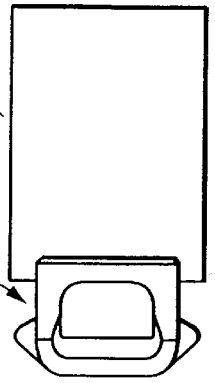
FIG. 6(*a*) is an assembly plan view showing a state where the connector assembly of the male connector and the lever in the first embodiment is fittingly connected to a female connector, FIG. 6(*b*) is an assembly side view.
Figure 6A:
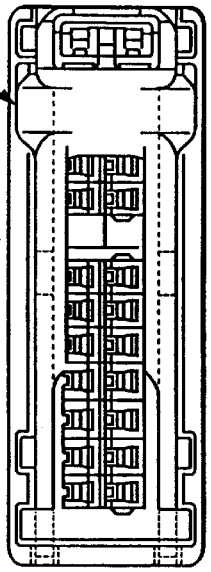
Figure 6C:
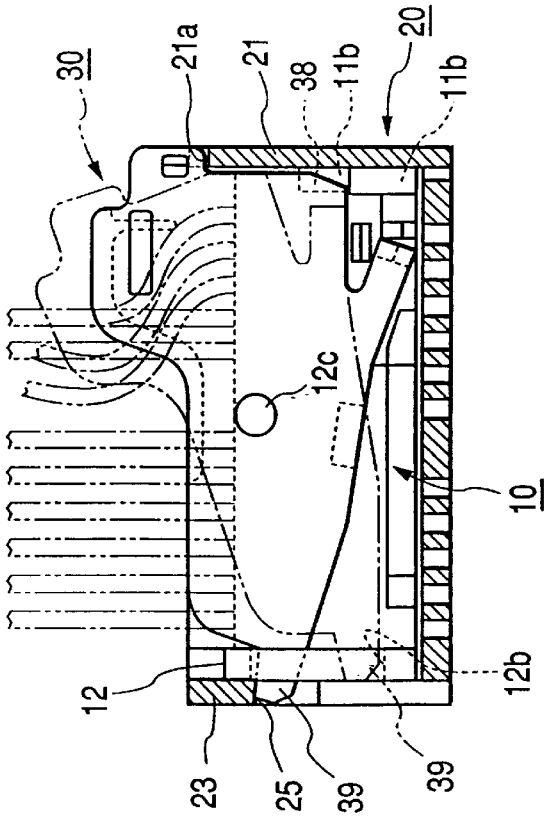
Figure 7:
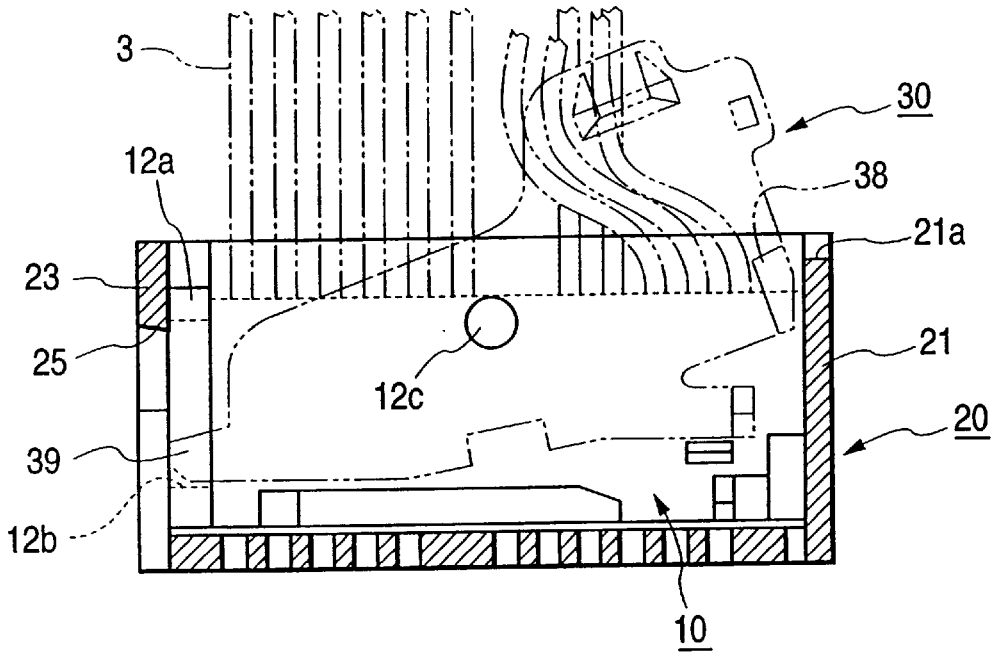
FIG. 7 is an assembly side sectional view showing a state where the connector assembly in the first embodiment has been fittingly connected to the female connector prior to pressing of the lever.
Figure 8:
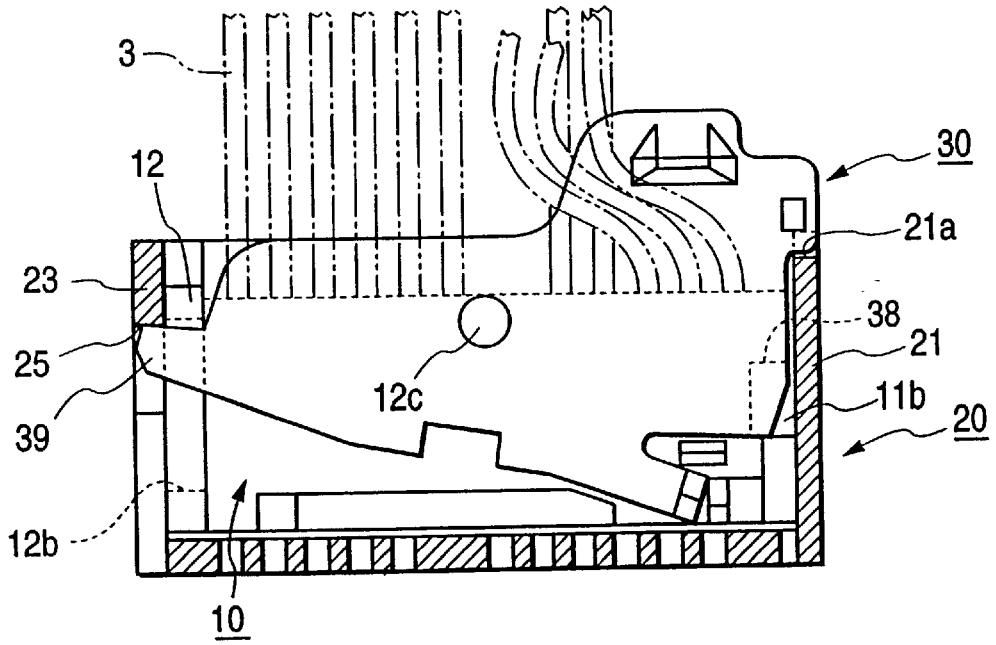
FIG. 8 is an assembly side sectional view showing a state where the connector assembly in the first embodiment has been fittingly connected to the female connector and the lever has been pressed.

Referring to FIGS. 6(*a*) to 6(*c*), 7, and 8, action point portions 39 are formed in the rear end portion of the lever body 31 configured as the frame of the lever 30. The action point portions 39 are always engagingly inserted into the slits 12*b* formed in the rear end portion of the male connector 10, and can be engaged and disengaged through the slits 12*b* with the engagement slits 25 formed in the rear end portion of the female connector 20, respectively. Thus, the action point portions 39 of the lever 30 are engagingly inserted into the engagement slits 25 of the female connector 20 through the slits 12*b* of the male connector 10. Thereafter, the lever is rotated so that the lever force appearing in the action point portions 39 causes the male connector 10 to be pressed against the rear side wall 23 of the female connector 20, thereby holding the male connector as shown in FIG. 6(*a*) (solid line) and FIG. 8.

In the configuration described above, the electrical connector of the first embodiment operates in the following manner. The male connector 10 is assembled as a combined structure of the two members, and the lever 30 is then attached to the male connector 10. The provisional connector assembly configured by the male connector 10 and the lever 30 is transported to the production step of fitting the assembly into the female connector 20. In this case, a large number of provisional connector assemblies are transported together. In the provisional connector assemblies, the protection due to the engagement of the slit 38 of the lever 30 and the rib 11*b* of the male connector 10 blocks the electrical wires 3 of one provisional connector assembly from being snagged into another provisional connector assembly. Therefore, the provisional connector assembly can be smoothly fitted into the female connector 20 so as to accomplish the connection.

When the male connector 10, which is in the use state as a result of the fitting connection to the female connector 20, is to be detached from the electrical connection box 4, the lever 30 is rotated about the support shaft pins 12*c* in the opposite direction or a counterclockwise direction. As a result, the male connector 10 can be easily separated from the female connector 20.

Figure 9:
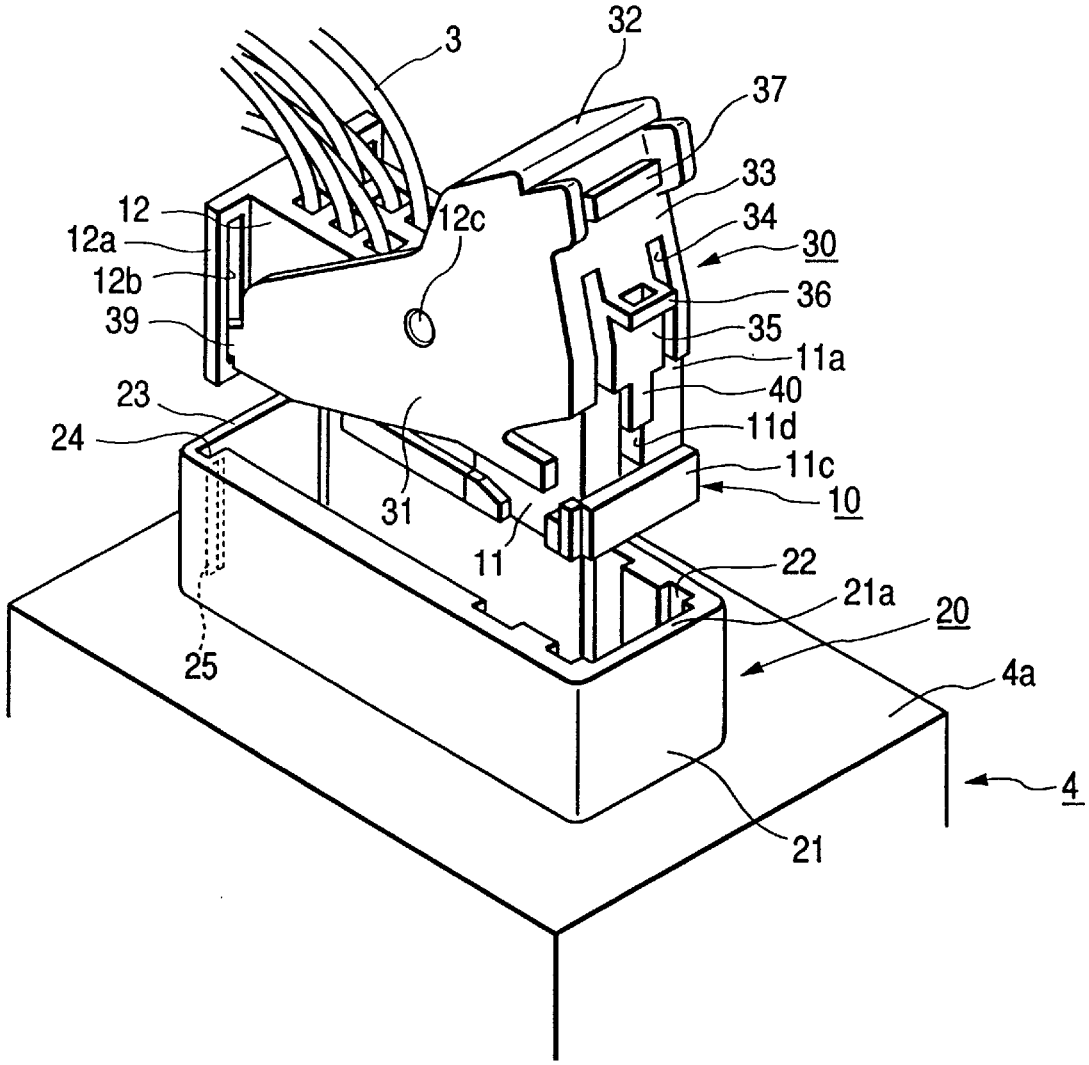
FIG. 9 is an exploded perspective view showing a state immediately before connection by fitting of an electrical connector in a second embodiment of the invention.
Figure 10:
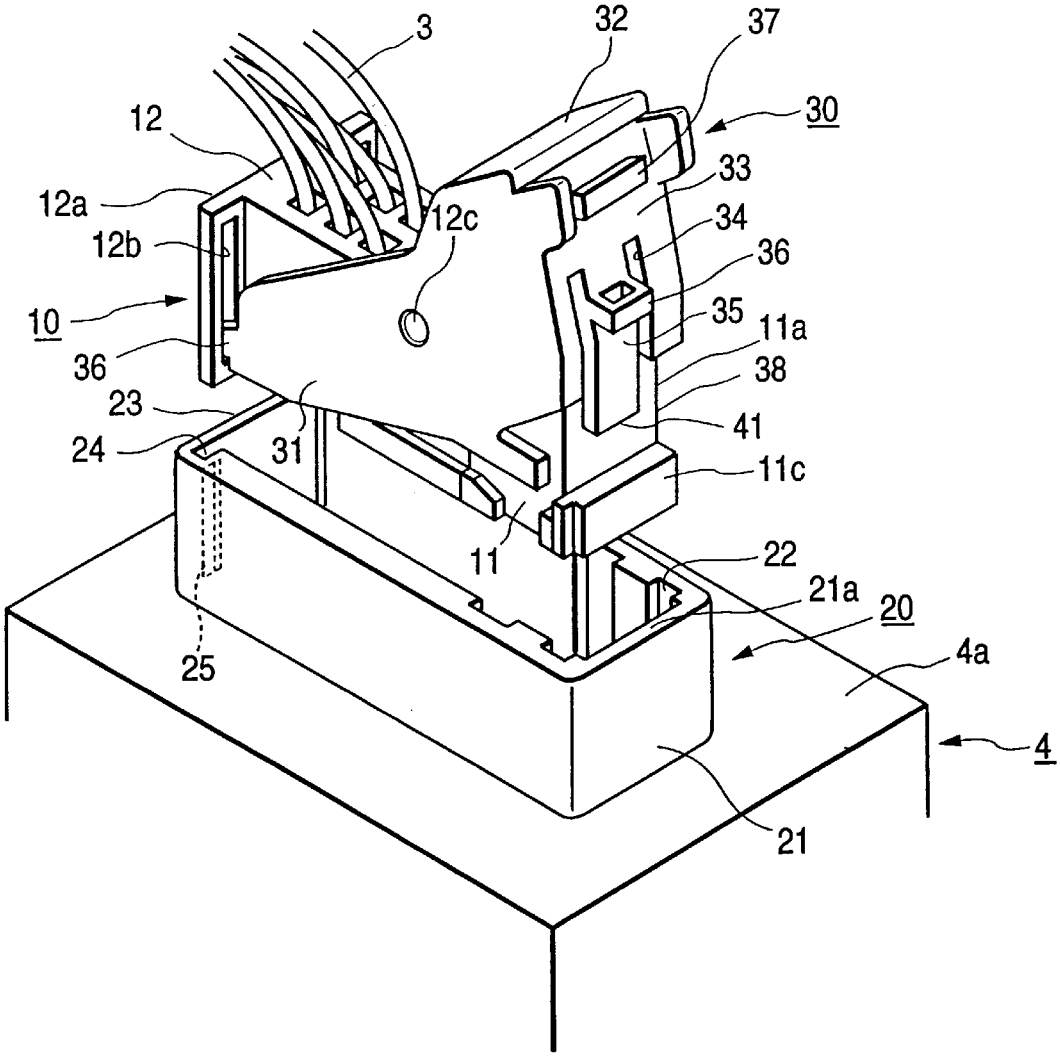
FIG. 10 is an exploded perspective view showing a state immediately before connection by fitting of an electrical connector in a third embodiment of the invention.

The invention is not restricted to the first embodiment described above, and may be realized also in the form of second and third embodiments shown in FIGS. 9 and 10 in which the structure of the protection means is modified.

In the second embodiment of FIG. 9, the recess and projection engagement relationships between the rib 11*b* on the side of the male connector 10 and the slit 38 on the side of the lever 30 in the protection means of the first embodiment is inverted. Namely, a stem-like rib 40 is formed on the lever 30 so as to extend downward from the lower end of the elastic lock piece 35 disposed in the front end face 33. At least a part of the stem-like rib 40 is engaged with the vertical slit lid formed in the front end face 11*a* of the male connector 10.

In the third embodiment of FIG. 10, in place of the stem-like rib 40 which extends from the elastic lock piece 35 of the lever 30 in the second embodiment of FIG. 9, a skirt portion 41 which is wide and thin is formed as the protection means. At least a part of the skirt portion 41 is always slidingly contactable from the outside with the front end face 11*a* of the male connector 10.

The function and effect attained in the configurations of the second and third embodiments are the same as those of the first embodiment.

As described above, in the electrical connector of the invention, a provisional connector assembly of the male connector and the lever for a fitting operation is provided with the protection means which cooperates with both the male connector and the lever to prevent a member of another provisional connector assembly, such as a wire harness from snagged in the provisional connector assembly. In the case such as where a large number of provisional connector assemblies of the male connector and the lever are transported together for connection by means of fitting with the female connector disposed in the electrical connection box, therefore, the wire harness of one provisional connector assembly is prevented from being snagged into another provisional connector assembly. As a result, the disadvantage of the prior art that the operation of pressing the lever in the fitting of the provisional connector assembly into the female connector is hindered is eliminated. The invention has a further advantage that it is possible to prevent the wire harness itself or the lever from being damaged by such snagging.

What is claimed is:

1. An electrical connector, comprising:

a first connector housing having a first terminal therein;

a second connector housing having a second terminal therein;

a lever rotatably secured to said first housing via a lever support shaft, said lever including an action point portion at one end for engaging said second connector housing and a force application point portion at an opposite end to which a pressing force can be applied by a user, said pressing force causing said lever to rotate to draw said first and second connector housings toward each other to interconnect said first and second terminals when said lever is rotated from an open position to a closed position, wherein when said lever is in said open position, a gap is formed between force application point portion and said first connector housing;

protection means for closing said gap between force application point portion and said first connector housing to prevent extraneous objects from entering said gap.

2. The electrical connector of claim 1, wherein said protection means includes a projection member which projects from said first connector housing toward said opposite end of said lever, and a recess provided in said opposite end of said lever in which said projection member is at least partially received.

3. The electrical connector of claim 2, wherein said projection member is received in said recess during an entire rotation stroke of said lever when moving from said open position to said closed position.

4. The electrical connector of claim 2, wherein said recess is a slot provided in an end face of said force application point portion and said projection member is a rib having a convex shape.

5. The electrical connector of claim 1, wherein said protection means includes a projection member extending from said opposite end of said lever and a recess provided in said first connector housing in which said projection member is at least partially received.

6. The electrical connector of claim 2, wherein said lever includes a pair of slits in a lower portion of said opposite end so as to define a deflectable locking piece, said recess being disposed between said slits.

7. The electrical connector of claim 5, wherein said lever includes a pair of slits in a lower portion of said opposite end so as to define a deflectable locking piece, said projection member being disposed between said slits.

8. The electrical connector of claim 6, wherein said locking piece includes an engaging projection for engaging an engaging recess provided in said second connector housing.

9. The electrical connector of claim 7, wherein said locking piece includes an engaging projection for engaging an engaging recess provided in said second connector housing.

10. The electrical connector of claim 2, further comprising an engaging step portion extending laterally from a bottom end of said projection member, said engaging step portion being received in an engaging groove formed in said second connector housing.

11. The electrical connector of claim 1, where said protecting means includes a skirt portion which extends from said opposite end of said lever toward said first connector housing, said skirt portion being in sliding contact with a front face of said first connector housing.

* * * * *